US007955453B1

(12) United States Patent
Kelley et al.

(10) Patent No.: US 7,955,453 B1
(45) Date of Patent: Jun. 7, 2011

(54) GRADIENT THERMOSETTING PLASTIC-BONDED EXPLOSIVE COMPOSITION, AND METHOD THEREOF

(75) Inventors: John M. Kelley, Owings Mills, MD (US); Raafat H. Guirguis, Fairfax, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 703 days.

(21) Appl. No.: 11/527,657

(22) Filed: Sep. 15, 2006

(51) Int. Cl.

| | |
|---|---|
| ***C06B 45/00*** | (2006.01) |
| ***C06B 45/12*** | (2006.01) |
| ***C06B 45/04*** | (2006.01) |
| ***D03D 23/00*** | (2006.01) |
| ***D03D 43/00*** | (2006.01) |

(52) U.S. Cl. ..... 149/109.6; 149/2; 149/14; 149/17

(58) Field of Classification Search ..... 149/17, 149/2, 14, 109.6
See application file for complete search history.

(56) References Cited

U.S. PATENT DOCUMENTS

| | | | | |
|---|---|---|---|---|
| 3,396,661 | A | 8/1968 | Michael | 102/430 |
| 3,811,380 | A | 5/1974 | Glass | 102/497 |
| 4,408,534 | A | 10/1983 | Araki et al. | 102/288 |
| 5,505,799 | A | 4/1996 | Makowiecki | 149/15 |
| 6,120,832 | A * | 9/2000 | Walsh et al. | 427/8 |
| 6,276,276 | B1 | 8/2001 | Erickson | 102/201 |
| 6,352,029 | B1 * | 3/2002 | Guirguis et al. | 102/286 |
| 6,833,037 | B1 * | 12/2004 | Hallam et al. | 149/19.91 |
| 2006/0222777 | A1 * | 10/2006 | Skoog et al. | 427/446 |

* cited by examiner

*Primary Examiner* — James E McDonough
(74) *Attorney, Agent, or Firm* — Fredric J. Zimmerman

(57) ABSTRACT

A process for manufacturing gradient structures uses multiple jet-spraying mechanisms to form layers of distinct precursors into a gradient composition.

8 Claims, 1 Drawing Sheet

GRADIENT THERMOSETTING PLASTIC-BONDED EXPLOSIVE COMPOSITION, AND METHOD THEREOF

STATEMENT OF GOVERNMENT INTEREST

Figure 1:
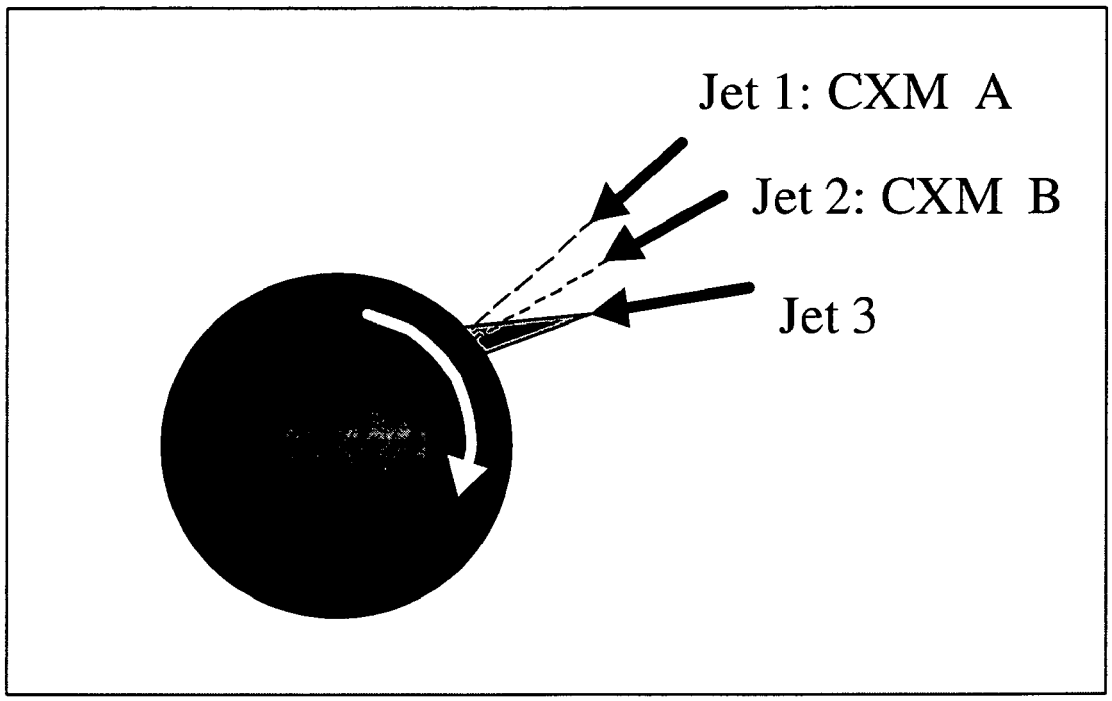

The invention described herein may be manufactured and used by or for the government of the United States of America for governmental purposes without the payment of any royalties thereon or therefor.

BACKGROUND OF THE INVENTION

The present invention jet-sprays thin layers of functional chemical compositions to produce a gradient structure, particularly in the field of energetic materials, such as explosives, propellants, gas-generants, pyrotechnics, hereinafter referred to as "explosives".

Robotic and manual paint spraying devices may be used to apply a liquid binder carrying solid pigments. Using this technique, thin layers of paint, including a binder and pigment component, can be easily deposited on surfaces. However, traditional paint sprays cannot focus on a small area, can only spray premixed paints which yield a uniform color distribution, and the application does not necessitate any solidification accelerants.

There is a need in the art to provide improved methodologies for the manufacture of spatially-graded energetic materials, such as gradient explosives. The present invention addresses this and other needs.

SUMMARY OF THE INVENTION

The present invention includes a process for manufacturing gradient structures including jet-spraying a plurality of structural components including jet-spraying a first structural component in combination with jet-spraying at least a second structural component, where the plurality of structural components are applied in a manner effective to produce a gradient structure. This process for manufacturing gradient structures is particularly useful in forming gradient explosives having specifically designed functional shapes.

The present invention also includes a process for manufacturing gradient explosives including applying a first explosive precursor and applying at least a second distinct explosive precursor in combination with the first precursor in a manner effective to form a gradient explosive composition. These gradient explosive compositions may include thermosetting, thermoplastic formulations, or solvated binder systems, e.g. lacquers.

DETAILED DESCRIPTION OF THE DRAWINGS

FIG. 1 illustrates an embodiment of the present invention of applying distinct layers of explosive precursors with an arrow representing the movement of the target area in relation to the application of layers from Jets 1, 2 and 3.

DETAILED DESCRIPTION OF EXEMPLARY EMBODIMENTS OF THE INVENTION

The present invention includes a process for manufacturing gradient structures, and, in an embodiment, gradient explosives. The process provides integration of individual and distinct structural precursors, and, in an embodiment, explosive precursor compositions into a larger scheme for building them, one layer at a time, into a gradient structure and, in an embodiment, gradient explosives. These gradient structures are formed on a substrate or a previously deposited layer of one or more of the precursors. The jet-spraying of the structural precursors or layers may be performed sequentially or substantially simultaneously, or a combination thereof, that is, the structural precursors or layers may be formed or applied sequentially or substantially simultaneously, or a combination thereof. The gradient structures advantageously use their gradient composition to maximize, functionally, the use of the chemical composition within the structure. For example, gradient explosives of the present invention may increase burn rate, decrease burn rate, dissipate the explosive shock wave, focus the explosive shock wave or otherwise alter the burn and potential of the explosive, as desired.

The present invention uses multiple jet-sprays to jointly apply a plurality of distinct precursors onto a target in a manner that creates a gradient composition of the final product. The composition includes jet-spraying a first structural component in combination with jet-spraying at least a second structural component. The jet-spraying of the structural components may be performed sequentially or substantially simultaneously, or a combination thereof. When properly combined the plurality of applied structural components produce a gradient structure. Additional structural components may be incorporated, such as jet-spraying at least third, fourth, fifth, etc. structural components, or the incorporation of pre-molded forms, particularly useful in forming void areas.

Application of the structural components is accomplished by alternating the layering of each of the structural components onto the target area, such as having the plurality of structural components applied to a moving target, having the plurality of structural components applied by moving the jet-spray relative to the target, or a combination of these methods. In an embodiment, the first and second precursors are applied to a fixed point on one or more moving supports, such as a rotating moving support, e.g., the explosive charge may be built by depositing successive individual layers on a rotating surface. Representative moving supports include rotating cylinders, disks, plates or other like supports that allow for the conjoint application of the precursors. In one alternative application, the jet-sprayers are rotated, either about a fixed point or moving point for proper application of the first, second, etc. precursors, such as with the use of multiple moving sprayers. Generally, the jet-spraying of the plurality of structural components is computer controlled, with repetition of the layering of the structural components producing a three dimensional structure by controlling the axial, radial and azimuthal location of the applied layers onto the target area.

With the layering and mixing application of the plurality of precursors, the manufactured gradient structures an, in an embodiment, gradient explosives may include gradient explosive layers or areas that include pure precursor compositions of any of the applied precursors, with other areas that incorporate various percentage mixtures of any of the applied precursors. For example, with the application of three distinct precursors, A, B and C, areas of the formed gradient explosive may include pure A, pure B, pure C, amounts of only A and B (for example, 45% and 55%, respectively), amounts of only A and C (for example, 60% and 40%, respectively), amounts of only B and C (for example, 20% and 80%, respectively) and amounts of A, B and C (for example, 52%, 33% and 15%, respectively). As seen in FIG. 1, in an embodiment, computer-controlled spray jets are used in applying thermosetting or thermoplastic formulations having precursors with differing explosive characteristics. The term "jet-spraying" as understood by one in the art, includes either an airless or gas conveying system to deliver the particular material, that is, the structural component material. The representative three (3) computer-controlled jets aim at a small focal area on the surface. Jet 1 carries coated explosive material, (CXM) A; including particles "A," which are coated with binding agent "a." Similarly, jet 2 carries a second distinct coated explosive material (CXM) B including particles "B" in a binding agent "b". For example, in a solvated system "a" may be the same as "b". The computer controls the volume of materials flowing through each jet, thus continuously adjusting the ratio A:B depending on the location of the focal point. The objective of jet 3 is to enhance the curing/setting/solidification process. For example, jet 3 can carry a solvent that softens binding agents a and b, making it easier for them to bond with particles A and B, then quickly evaporates, thus leaving a quasi-solid material at the spot. Alternatively, jet 3 represents either (1) a chemical curative or (2) a process aid, such as, a source of ultraviolet radiation, a heat source, or an intense source of infrared radiation that heats the focal point, either (1) kinetically-accelerating the localized chemical cure of the binder or (2) quickly softening binding agents a and b. As the focal point of the 3 jets moves to a neighboring location, the temperature drops and agents a and b either (1) gel or (2) re-solidify after bonding with particles A and B.

This application of the individual precursors allows for the direct control of the gradient composition of the formed structure, improving the accuracy of precursor location and allowing a specified precursor mix layer by layer. By applying the precursors as alternating individual layers, the gradient formed may include a gradual change in explosive composition smaller than the size of the individual constituents within each of the precursors. Application of a curative is generally withheld until after the explosive precursors are layered onto the target surface. In thermosets, however, the curative and cure-catalyst are soluble in the binder, and thus generally do not themselves constitute a distinct layer. More rapid application of the chemical-curative (i.e.; between CXM layers Aa and Bb) generally provides a shorter diffusion path through each half-layer, rather than requiring diffusion through the CXM layer thickness $\{\frac{1}{2}\times(Aa+Bb)\}$, promoting a more ideal cure stoichiometry and physically-robust assembled structure. In one embodiment, both cure-catalyst and curative are incorporated in CXM's Aa and Bb, relying upon such known paint-spraying technologies as in-head mixing just prior to spray-deposition. For example, with the application of the first precursor (having explosive constituents) a thin film is formed on the target surface. Application of the second precursor, in addition to attaching the second explosive constituents on top of the explosive constituents of the first precursor, may include dispersal of the second film that deposits explosive constituents of the second precursor between the layered explosive constituents of the first precursor. As such, there is generally no unwanted distinct layering of explosive material, i.e., adjacent pure layers of the reactive components of the first and second precursors. In an embodiment, the process of the present invention is conducted within a controlled environment in order to isolate the charge from air and humidity, with inert gas atmospheres most preferred, such as argon or nitrogen. Preferably, potential hazards related to electrostatic discharge are addressed and controlled within such an environment.

Others skilled in the art of surface deposition and in the art of chemical bonding (as well as activation thereof) will realize that other variations of the specifics of the technique described above are possible. For example, different physical phenomena or specific chemical compounds may be devised to increase the rate of solidification in building gradient explosives or other reactive and unreactive graded structures using two or more computer-controlled jets focusing at a continuously-moving point on a surface that is slowly built one thin layer at a time. Representative precursors have any appropriate particle sizes for the application to a focal point in combination with other precursors, such as for example from about 10 microns to about 100 microns, with the precursors having sufficient consistency to support the energetic and non-energetic fillers.

As may be readily understood by those in the art of gradient explosives in light of the instant disclosure, the present invention applies extremely thin layers of precursor as to form a cumulative structure that is absent of any distinct layers of explosive. Accordingly, a substantially uniform thickness may be achieved in the gradient structure. Importantly, as such, explosive shock waves that travel through the gradient structure during burn, such as detonation, are not subject to interference by abrupt lines or areas of changing compositions. By being free of these lines of instant or rapid composition changes, burn progresses through the gradient explosive structure unimpeded due to the absence of disruptive areas which minimizes any discontinuity of the burn. With the overlap of different layers, the gradient explosive merges the layers into a gradient system that effectively eliminates the layers. Generally, areas of change within the gradient explosive structure include a progressive change in composition ranging from about less than the particle sizes of any of the reactive materials within the precursors to about ten times one or more of these particle sizes, such as from about 1 micron to about 1000 microns, with the gradient explosive, in an embodiment, having a maximum thickness of the different layers of the same order as the particle size, e.g., from about 200 μm or less, including from about 10 μm to about 100 μm and from about 20 μm to about 50 μm. The same benefits indicated above may be useful in applications other than gradient explosives, such as, a gradient structure requiring minimum discontinuity among layers.

In an embodiment, the gradient explosive is formed into a functional shape. Functional shapes include those shapes that use the physical dimensions of the gradient explosive advantageously to exploit the gradient properties of the explosive. These specifically designed end-use configurations may include any appropriate physical dimensions for operational use, such as energy focusing shapes, energy dispersal shapes, energy delay-release shapes, energy coupling shapes, initiation sites, and combinations thereof. The layering of the energetic and non-energetic components of the functional shape allows for great versatility in imparting proper volume fraction or load bearing of the explosives into the structure. In various embodiments, the gradient explosive of the present invention include a propellant composition or high energy warhead.

In the manufacture of gradient explosives, a first explosive precursor is applied in combination with the application of at least a second distinct explosive precursor in a prescribed manner to form, effectively, a gradient composition. In forming a gradient explosive, a plurality of energetic compositions, such as thermosetting plastic-bonded explosive precursors, constitute the applied structural components, e.g., manufacturing a gradient thermosetting plastic-bonded explosive by applying the first thermosetting plastic-bonded explosive precursor and applying the second distinct thermosetting plastic-bonded explosive precursor in combination with the first precursor, with the optional application of the third precursor, fourth precursor, etc. When thermosetting plastic-bonded explosive precursors are used, the application of a curative to the thermosetting plastic-bonded explosive precursors, e.g., the applied first, second, and optionally third, fourth, etc. precursors, is generally performed to cure the applied thermosetting plastic-bonded precursors into the gradient explosive. For example, the explosive precursors are individually prepared and mechanically deposited onto the target surface in a thin, uniform layer, with a spray application of a liquid curative then applied to the layered precursor to start cross-linking in the polymer. In a distinct example, the curative and catalyst are pre-incorporated in CXM. By varying the application of the curative, e.g., changes in the polymer-to-curative ratio at a constant volume-percent of binder provides changes in the structural or mechanical characteristics of the assembled structure. The curative may be sprayed on the surface of the layering material without mixing into the underlying layer, that is, the curative is not thoroughly incorporated into the mix, and thus permeates inward.

Representative precursors for forming the gradient explosive include thermosetting plastic bonded explosives loaded with energetic material crystals, such as trinitrotoluene (TNT) (also considered a theromoplastic), cyclotrimethylenetrinitramine (RDX), cyclotetramethylenetetranitramine (HMX), hexanitrohexaazaisowurtzitane (CL-20), ammonium perchlorate (AP), pentaerythritol tetranitrate (PETN), tetryl (trinitrophenylmethylnitramine) and mixtures of one or more of these, particularly finely divided compositions, bonded with a high viscosity nitrocellulose plasticized with triethyleneglycol dinitrate (TEGDN), etc., fuels such as aluminum, boron, magnesium, lithium, etc., and combinations thereof, formed in a polymeric binder, which is chemically cured, with at least two distinct precursors used in the formation of the gradient explosive. Application of the precursor is applied in light of particular physical characteristics of the explosive, such as even when well-plasticized, NC is generally not spray-applicable unless also solvated, as for a lacquer. When simply plasticized (e.g.; NG, TEGDN), NC becomes a swollen rubber-like material. In particular, a combination of two precursors that include HMX, RDX, AP, aluminum, boron, magnesium or lithium are used, with appropriate safety considerations as the components become increasingly reactive, e.g., lithium.

Curatives are added in appropriate amounts, such as, an amount from about 0.5 wt % to about 3 wt %, and one or more cure catalysts may be added, such as, in an amount from about 0.01 wt % to about 2 wt %. Exemplary curatives for the hydroxy-multifunctional polydiolefin prepolymers and carboxy-functional polydiolefin prepolymers are chain-extending diisocyanates, such as isophoronediisocyanate (IDPI), dimeryldiisocyanate (DDI), toluene diisocyanate (TDI), and tetramethylxylene diisocyanate (TMXDI), although it is within the scope of this invention to use polyisocyanates. Exemplary curatives for the carboxy-functional polydiolefin prepolymers include aziridine compounds and epoxides. Epoxy curatives also are suitable for curing the polyacrylates. Exemplary cure catalysts include Lewis acids, triphenylbismuth, and alkyltin compounds, such as dibutyltindiluarate. Representative curatives also include, for example, energetic curatives, augmented by tackifiers, vibration, heat, ultraviolet or infrared light, and combinations thereof, with a curative of IDPI generally.

Non-energetic plasticizers when used in the present invention may include for example DOA (dioctyladipate), dioctylsebacate (DOS), IDP (isodecylperlargonate), DOP (dioctylphthalate), DOM (dioctylmaleate), DBP (dibutylphthalate), and the like, and mixtures thereof. Suitable binders for the present invention may include one or more members of hydroxy-functional polydiolefin prepolymers, such as HTPB (hydroxy-terminated polybutadiene) and hydroxy-terminated polyisoprene; and carboxy-functional polydiolefin prepolymers, such as CTPB (carboxy-terminated polybutadiene) (available from ATK/Thiokol). Also suitable for the invention is PBAA (poly (butadiene-co-acrylonitrile-co-acrylic acid), available from American Synthetic Rubber. Polyacrylates and polymethacrylates reacted with small amounts of a comonomer (e.g., acrylic acid) may also be used.

Gradient explosive products of the present invention provide improved explosive safety in the manufacture (such as smaller mass instantly subjected to the mechanical work of processing), and final use (such as lowered collateral damage via output instantaneously tailorable in real-time to the specific target of the explosive). Additionally, specifically processed explosives of the present invention are particularly useful in many specialized military and commercial applications by providing an explosive having the appropriate burn and energy release characteristics for a given situation. For example, gradient explosives are particularly useful in multiple-function warheads or solid-propellant rockets with additional degrees of freedom for energy-management, such as in tailoring detonation fronts, increasing performance of shaped-charge jets, providing versatility in variable-output explosives, and variance of multiple modes, structural and mechanical properties of single charge systems. (Examples 1-8 are prophetic and Example 9 is actual).

Example 1

A first explosive precursor is applied as a thin layer to a target area having particles with an average size of about 200 μm. As further layers of the explosive precursor are applied, a second explosive precursor is applied with an average particle size of about 100 μm in combination with the application of the first precusor. With the continued application of the first and second precursors, the relative amount of the first precursor is decreased and the relative amount of the second precursor is increased until a final layer of about 100% second explosive precursor constitutes the final layer.

Example 2

The first and second explosive precursors are applied as thin layers to a target area as detailed in Example 1, with the additional application of a third explosive precursor including an average particle size of about 50 μm. Once the application of 100% second explosive precursor is applied, the third explosive precursor is applied in increasing amounts until 100% third explosive precursor constitutes the final layer.

Example 3

The first and second explosive precursors are applied as thin layers to a target area as detailed in Example 2, except the third explosive precursor is applied once the first and second explosive precursors are being applied in a relative amount of 50%/50%, and is continued until the three precursors are applied in equal relative amounts.

Example 4

The first and second explosive precursors are applied as thin layers to a target area as detailed in Example 1, with a curative applied within the second explosive precursor composition.

Example 5

The first and second explosive precursors are applied as thin layers to a target area as detailed in Example 1, with a curative applied in a third applied composition.

Example 6

The first and second explosive precursors are applied as thin layers to a target area as detailed in Example 2, except the amount of explosive material in the first explosive precursor is doubled. In this Example 6, the gradient explosive composition has distinct explosive properties from the explosive composition detailed in Example 2.

Example 7

The first and second explosive precursors are applied as thin layers to a target area as detailed in Example 2, except the amount of explosive material in the first explosive precursor is halved. In this Example 7, the gradient explosive composition has distinct explosive properties from the explosive composition detailed in Example 2.

Example 8

The first and second explosive precursors are applied as thin layers to a target area as detailed in Example 2, except a third explosive precursor layer having a distinct explosive material composition is applied with the first and second explosive precursors. In this Example 8, the gradient explosive composition has distinct explosive properties from the explosive composition detailed in Example 2.

Example 9

A prototype was produced by the process of the present invention showing the feasibility of the process. An inert volumetric-analog of PBXN-110 was prepared in which HMX was replaced by aluminum using about 77% by volume aluminum particles and 23% HTPB binder. The binder was about 45% R45 polymer, 45% IDP plasticizer, and 10% other ingredients. The curative was IDPI.

With a spatula the pre-mix (sans IDPI) was formed into a 2 mm deep circular depression machined into the bottom half of a casting mould. IDPI was sprayed on the uncured surface and the mould was sealed. As a control measure, a hand-mix in which the curative was thoroughly mixed was also prepared from the same batch to demonstrate its cure potential. Curing was completed in a +120° F. oven. In both mixes, the cure-catalyst level was moderately increased to accelerate material stiffening, as might be done to prevent material "slump" in a practical process.

The mould was disassembled after 3½ days and the wafer easily extracted. However, the behavior of the control hand-mix indicated that it was well on its way to curing after about a couple of hours. This status demonstrated that to achieve cure in a 2 mm thick layer, the curative does not need to be thoroughly incorporated into the mix and spraying it on the surface may be adequate. A uniform thickness of the layer was observed.

The thickness of the wafer was intentionally selected to be greater than would be the case in a gradient explosive. Additionally, the IPDI was sprayed on only one side in order to increase the thickness the curative was required to permeate. This results demonstrates that in a "worst-case" thickness scenario and within a reasonable amount of time, the curative still can adequately diffuse. It should be noted that in the developed method the curative diffusion distance, and hence the time, should be shorter (faster) than as shown in this Example 9.

The foregoing summary, description, and examples of the present invention are not intended to be limiting, but are only exemplary of the inventive features which are defined in the claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A process for manufacturing a gradient structure, comprising:

jet-spraying a plurality of structural components, comprising:

jet-spraying a first structural component, in combination with; and jet-spraying at least a second structural component, wherein the plurality of structural components are applied in a manner effective to produce a gradient structure, and wherein said gradient structure comprises a polymeric energetic material of a substantially uniform thickness absent any distinct layers.

2. The process of claim 1, further comprising jet-spraying at least a third structural component.

3. The process of claim 1, wherein the plurality of structural components are applied to a moving target.

4. The process of claim 1, wherein the plurality of structural components are applied by moving the jet-spray relative to a target.

5. The process of claim 1, wherein the jet-spraying of the plurality of structural components is computer controlled so as to control at least one of axial, radial, and azimuthal location of applied said plurality oil structural components.

6. The process of claim 1, wherein the gradient structure is one of an increasing gradient energetic material and a decreasing gradient energetic material.

7. The process of claim 6, wherein the plurality of applied structural components are thermosetting plastic-bonded explosive precursors.

8. The process of claim 1, wherein the jet-sprayed plurality of structural components forms a functional shape.

* * * * *